United States Patent [19]

Lüthi et al.

[11] 4,102,625

[45] Jul. 25, 1978

[54] SPINNERET HOLDER

[75] Inventors: Fritz Lüthi, Kehrsatz; Guido Bach, Ostermundigen, both of Switzerland

[73] Assignee: Ing. A. Maurer S.A., Bern, Switzerland

[21] Appl. No.: 773,191

[22] Filed: Mar. 1, 1977

[30] Foreign Application Priority Data

Mar. 2, 1976 [CH] Switzerland ..... 2576/76

[51] Int. Cl.[2] ..... B29F 3/04

[52] U.S. Cl. ..... 425/464; 425/198; 425/382.2

[58] Field of Search ..... 425/191, 192 S, 378 S, 425/382.2, 464, 198; 220/327, 328

[56] References Cited

U.S. PATENT DOCUMENTS

| | | | |
|---|---|---|---|
| 946,329 | 1/1910 | Brown | 220/327 |
| 2,879,543 | 3/1959 | McDermott | 425/191 |
| 3,553,774 | 1/1971 | Ruck et al. | 425/192 S X |

FOREIGN PATENT DOCUMENTS

| | | | |
|---|---|---|---|
| 494,449 | 3/1976 | U.S.S.R. | 425/464 |

*Primary Examiner*—Francis S. Husar
*Assistant Examiner*—John McQuade
*Attorney, Agent, or Firm*—Michael J. Striker

[57] ABSTRACT

A spinneret holder has a pressurizable chamber formed between a cupped base part having a rim centered on an axis and a cover part having a periphery snugly interfittable with the rim. A plurality of spinnerets is provided in the cover part so that a mass to be spun can be introduced into the chamber and exit as filaments from the spinneret. A rod or bolt lying on the axis has threads anchored in one of the parts and the other part is formed at the axis with the throughgoing holes through which the rod passes. Thus an element such as a head or nut on the rods bears axially on the other part and can press the rim of the base part nad periphery of the cover part axially tightly together.

12 Claims, 3 Drawing Figures

SPINNERET HOLDER

BACKGROUND OF THE INVENTION

The present invention relates to a spinneret holder. More particularly this invention concerns such a holder in which a plurality of spinnerets can be mounted.

In order to form a synthetic-resin yarn it is standard practice to fit a plurality of spinnerets in a holder. The holder has a hollow interior defining a closed chamber and the spinnerets are mounted in one wall of the holder. A mass to be spun is forced under pressure into the holder so as to issue from the spinnerets as a plurality of filaments which can be later spun and treated in a manner well known in the art.

A multijet coupling or spinneret holder is known where the spinnerets are all mounted in a so-called cover plate that is secured by means of a complex clamping ring having a plurality of screws to a base part. Together the cover part and base part form the above-mentioned closed chamber which is filled with the pressurized mass to be spun.

Such an arrangement has the considerable disadvantage that in case of clogging of any of the spinnerets or jets it is necessary to disassemble the entire holder and clear the blocked spinneret or spinnerets. Such an operation is a relatively lengthy task in the known systems wherein the clamping arrangement is quite complex.

It has been suggested to provide a simpler clamping means, however, none has proved itself useful in practice since the pressure of the mass to be spun is relatively high, and leakage cannot be tolerated. Thus recourse has always been had to the above-mentioned type of relatively complex clamping rings using a plurality of tightenable clamping elements such as bolts. This of course leads to the problem of unequal clamping pressure around the seam or joint between the cover and base part, with concomitant leakage. Furthermore this arrangement is normally complicated by the necessity of clamping between the two parts a screen or filter cloth intended to prevent particles or the like in the spun mass from reaching the spinnerets and blocking them.

SUMMARY OF THE INVENTION

It is therefore an object of the present invention to provide an improved multijet coupling or spinneret holder.

Another object is the provision of an improved spinneret holder which can be easily disassembled for servicing.

Yet another object is to provide such a spinneret holder which when closed forms an excellent tight seal.

Yet another object of this invention is the provision of a spinneret holder which can easily clamp a filter screen or cloth between the inlet for the mass to be spun and the spinneret.

These objects are attained according to the present invention in a spinneret holder comprising a cupped base part having a rim centered on an axis and a cover part having a periphery snugly interfittable with the rim and defining with the base part a generally closed chamber centered on the axis. A plurality of spinnerets is mounted in the cover part so that a mass to be spun can be introduced into the chamber and exit as filaments from the spinnerets. A rod lies generally on the axis of the base and cover part and has threads anchored in one of these parts. The other part is formed at the axis with a throughgoing hole through which the rod passes. An element on the rod bears axially on the other part and presses the rim of the base part and the periphery of the cover part axially tightly together.

Thus the spinneret holder according to the present invention is very tightly sealed in an extremely simple manner. Since the rim of the base part is centered on the axis and the periphery of the cover part is snugly interfittable with this base pressure brought to bear by the element on the rod will insure perfectly even sealing all around the seam or joint between the two parts.

According to another feature of this invention the rod is threaded at its lower end into the base part and has a threaded upper end on which a nut constituting the element is threaded. Thus the rod constitutes a stud, and rotation of the nut will serve to hold the cover and base part tightly together. It is of course within the scope of this invention to anchor the rod in the cover part and have it project through a hole in the base part, and similarly to form the rod as a bolt so that the element is merely the head of the bolt.

In accordance with yet another feature of this invention the base part is formed with a radially throughgoing inlet which is offset from the axis. Means is provided including a conduit connected to the base part at the inlet for feeding a mass to be spun under pressure to the chamber defined between the base part and cover part. This chamber is upwardly flared in the base part toward the cover part.

The cover part according to yet another feature of the present invention is downwardly concave or dished toward the base part and has at its periphery a planar face lying in a plane perpendicular to the axis of the assembly. In addition the base part has a stepped rim formed with a shoulder between a face lying in a plane perpendicular to the axis and another surface lying on a cylinder centered on the axis. Thus the cover part, which extends up beyond the base part, can be recessed in the base part and form an extremely tight and neat seal therewith.

According to further features of this invention there is provided at the joint between the two parts an annular seal ring. This seal ring may be received within a radially outwardly open groove formed in the outer periphery of the cover part. Similarly this cover part is formed at its axially central throughgoing hole with an inwardly open groove in which is provided another such seal ring resiliently engaging the rod. The cover part is also formed in accordance with this invention with a plurality of throughgoing holes each receiving a respective spinneret and each formed with an inwardly open groove in which is received a respective elastomeric seal ring that resiliently engages the respective spinneret. These spinnerets have enlarged ends inside the chamber, and are resiliently held in place by the respective seal rings. No particular clamping arrangement is necessary for the spinnerets since during operation pressurization of the chamber will hold them perfectly in place.

Finally according to this invention the chamber which is largely formed by the base part is of frustoconical shape and flares toward the cover part. The inlet opens radially into this chamber at a location spaced from the cover part so that a good mixing of the mass to be spun is obtained. Similarly a filter screen or the like can easily be clamped between the cover part and base part, so that its removal is effected simply by loosening the above-mentioned rod. This arrangement is particularly useful for the production of cellulosic fibers by the viscose process.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

DESCRIPTION OF A PREFERRED EMBODIMENT

Figure 1:
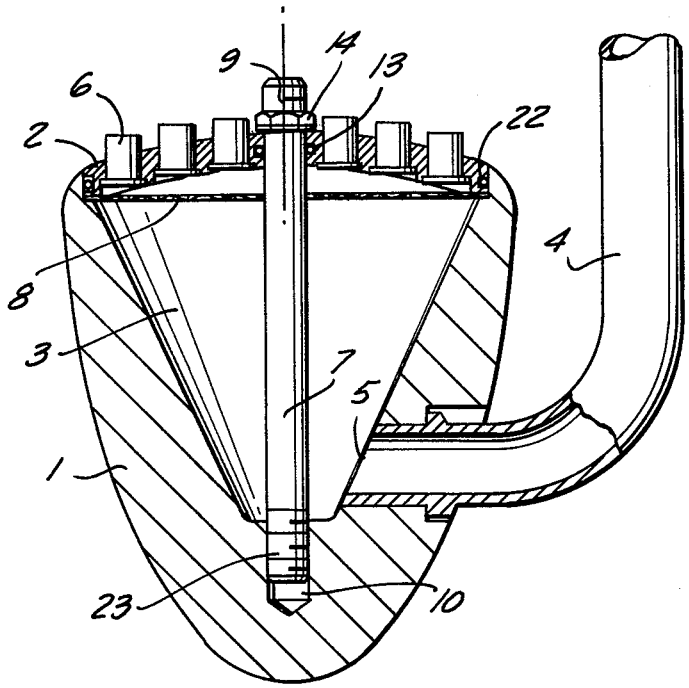
FIG. 1 is an axial section through the spinneret holder according to this invention.
Figure 2:
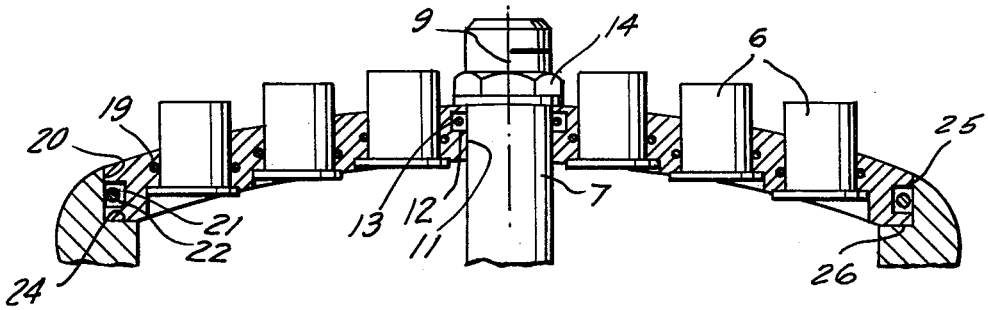
FIG. 2 is a large-scale view of a detail of FIG. 1.

As shown in FIG. 1 a spinneret holder according to this invention comprises an upwardly cupped base part 1 and a downward concave cover part 2 together defining an upwardly flared frustoconical chamber 3. A mass to be spun can be introduced into this chamber 3 via a conduit 4 opening at an inlet 5 formed in the base part 1 adjacent the bottom end of the chamber 3 thereof. The cover part 2 carries a plurality of spinnerets 6 and is secured to the base part 1 by means of a rod 7. A screen 8 to filter out particles from the mass introduced to the chamber 3 is clamped between the cover 2 and base 1. The rod 7 has a vertical central axis 9 and the cover 1 and base 2 are both formed substantially as bodies of revolution centered on this axis 9.

At its lower end the rod 7 has a threaded region 23 which is received in a threaded hole 10 formed on the axis 9 in the bottom of the base part 1. The cover 2 is formed centrally with a cylindrical hole 11 and in this hole 11 with a radially inwardly open groove 12 in which is provided an O-ring 13 that bears resiliently on the outer surface of the rod 7. At its upper end this rod 7 is provided with a head or nut 14 which when rotated about the axis 9 bears axially downwardly on the cover part 2 so as to secure it to the base part 1.

Figure 3:
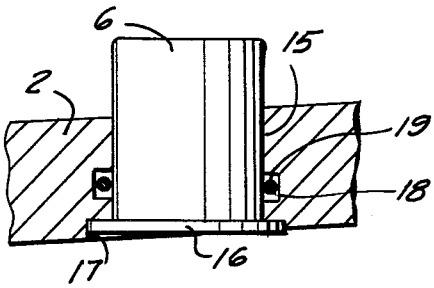
FIG. 3 is a large-scale view of a detail of FIG. 2.

The cover part 2 is formed as a portion of a hollow sphere and is concave downwardly toward the base part 1. This cover part 2 has an array of throughgoing cylindrical holes 15 extending perfectly parallel to the axis 9 as shown in FIG. 3 and having at the underside of the cover 2 a cylindrical counterbore 17 adapted to receive a radially extending flange on the respective spinneret 6. Furthermore each of these throughgoing cylindrical bores 15 is formed with a radially inwardly open groove 18 provided with a respective O-ring 19 that bears resiliently on the outside of the cylindrical spinneret 6. The O-rings 19 alone serve to hold the spinnerets 6 in place, and once the arrangement is in operation pressurization of the chamber 3 by means of the conduit 4 insures that the spinnerets 6 will remain tightly in place.

The base part 1 is formed at its upper end with a rim constituted by a pair of surfaces 20 and 24. The surface 24 lies in a plane perpendicular to the axis 9 and the surface 24 lies on a cylinder centered on the axis 9 and extending at right angles to the surface 24. In addition the cover 2 has a rim formed by a pair of surfaces 25 and 26 complementary to the surfaces 20 and 24, respectively, and snugly fitting therewith. The outer diameter of the cover 2 at the surface 25 is the same as the inner diameter of the base 1 at the surface 20. In addition the cover 2 is formed on its outer periphery at the surface 25 with an outwardly open groove 21 in which is received an O-ring 22 that is of elastic material and resiliently engages the surface 20. The cover 2 is made at least partially of resiliently deformable material so that as the portion 14 of the rod 9 is rotated it will be pressed tightly down into planar surface engagement between the surfaces 24 and 26 with the base 1 and will form a very tight seal therewith.

The arrangement according to the present invention is therefore extremely simple in construction and sure in use. The filter cloth 8 clamped between the surfaces 24 and 26 is very tightly held in place and in no way interferes with the seal formed at these surfaces, especially since the O-ring 22 serves to back up the seal. Dismantling of the holder is a relatively simple process, easily effected by rotation of the element 14 about the axis 9.

It will be understood that each of the elements described above, or two or more together, may also find a useful application in other types of structures differing from the types described above.

While the invention has been illustrated and described as embodied in a spinneret holder, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

We claim:

1. A spinneret holder comprising:
   - a cupped base part having a rim centered on an axis;
   - a cover part having a periphery snugly interfittable with said rim and defining with said base part a generally closed chamber centered on said axis;
   - a plurality of spinnerets mounted on said cover part;
   - means for introducing a mass to be spun into said chamber and for expelling said mass as filaments from said chamber through said spinnerets;
   - a rod lying generally on said axis and having threads anchored in one of said parts, the other part being formed at said axis with a throughgoing hole through which said rod passes; and
   - an element on said rod bearing axially on said other part only immediately adjacent said hole thereof and pressing said rim and said periphery axially tightly together, said other part having an axial face turned away from said one part and engaged only by said element said parts being pressed axially together at said rim and periphery exclusively by means of said rod and element.

2. The holder defined in claim 1, wherein said base part is formed with a radially throughgoing inlet offset from said axis, said means for introducing a mass including a conduit connected to said base part at said inlet for feeding a mass to be spun under pressure to said chamber.

3. The holder defined in claim 1, wherein said rim is formed with a shoulder normally radially surrounding said periphery.

4. The holder defined in claim 1, wherein said rod has one threaded end formed with said threads and anchored in said one part and an opposite threaded end, said element being a nut threaded onto said opposite end of said rod.

5. The holder defined in claim 1, wherein said cover part is concave toward said base part.

6. The holder defined in claim 1, wherein said cover part is formed with a plurality of throughgoing axially extending holes each receiving a respective one of said spinnerets, said cover part being formed at each of said throughgoing holes with an inwardly open groove and being provided in each of said grooves with a respective elastomeric seal ring resiliently engaging the respective spinneret.

7. The holder defined in claim 1, wherein said chamber is flared toward said cover part.

8. The holder defined in claim 1, wherein both of said parts are substantially formed as bodies of revolution centered on said axis.

9. The holder defined in claim 8, wherein said periphery and said rim are substantially circular and each have a face lying in a respective plane substantially perpendicular to said axis, said faces being flatly axially engageable with each other.

10. The holder defined in claim 9, wherein said base part is formed at said rim with a cylindrical surface extending parallel to said axis from the respective face, said periphery being receivable within said surface.

11. The holder defined in claim 1, wherein said cover part has an axial face turned toward said base part and engaged only with said spinnerets and with said rim.

12. A spinneret holder comprising:

a cupped base part having a rim centered on an axis and formed by a flat substantially planar and annular base surface lying in a plane substantially perpendicular to said axis and a substantially cylindrical side surface substantially parallel to said axis;

an at least partially resiliently deformable cover part concave toward said base part and having a periphery formed by a flat substantially planar and annular face surface flatly engageable with said base surface and a substantially cylindrical edge surface of substantially the same diameter as said side surface and juxtaposable therewith, said parts together forming a closed chamber on said axis;

a plurality of spinnerets mounted on said cover part;

means including an inlet through said base part opening into said chamber for introducing a mass into said chamber and for exiting of said mass as filaments from said spinnerets;

a rod lying generally on said axis and having one end anchored in one of said parts, the other part being formed at said axis with a throughgoing hole and said rod having another end extending axially through said hole; and means including an element on said rod bearing axially on said other part at said hole for pressing said parts axially together and for simultaneously deforming at least said cover part and thereby pressing said rim and periphery tightly together.

* * * * *